US007147594B1

(12) United States Patent
Vittone

(10) Patent No.: US 7,147,594 B1
(45) Date of Patent: Dec. 12, 2006

(54) SYSTEM FOR POSITIONING USER SUPPORT OF EXERCISE DEVICE

(76) Inventor: William M. Vittone, 127 Monticello Rd., Oak Ridge, TN (US) 37830

( * ) Notice: Subject to any disclaimer, the term of this patent is extended or adjusted under 35 U.S.C. 154(b) by 35 days.

(21) Appl. No.: 11/017,898

(22) Filed: Dec. 21, 2004

(51) Int. Cl.
*A63B 26/00* (2006.01)

(52) U.S. Cl. ..... 482/142; 482/95; 482/92

(58) Field of Classification Search ..... 482/92–104, 482/142, 148; D21/622, 676, 686, 690
See application file for complete search history.

(56) References Cited

U.S. PATENT DOCUMENTS 6,450,927 B1 * 9/2002 Ellis ..... 482/94
2004/0157711 A1 * 8/2004 Regev ..... 482/142

* cited by examiner

*Primary Examiner*—Lori Amerson
(74) *Attorney, Agent, or Firm*—Luedeka Neely & Graham P.C.

(57) ABSTRACT

A system for positioning a user support of an exercise device, including a user support having a user support surface; a pair of positioning members connected to the user support, each positioning member extending outwardly from opposite sides of the user support and being substantially aligned along a common axis; a frame configured for supporting exercise weights and including a pair of spaced apart portions, the spacing between the spaced apart portions of the frame defining a space configured for receiving the user support; and a guide located on each of the spaced apart portions of the frame, each guide defining a plurality of receivers each of which is configured for receiving a portion of one of the positioning members, with the guides each located such that the receivers of each guide are in substantial registry with one another, wherein the user support is adjustably and incrementally positionable relative to the frame by selectively positioning the positioning members so that they are received by the receivers to effect selective positioning of the user support relative to the frame.

10 Claims, 4 Drawing Sheets

SYSTEM FOR POSITIONING USER SUPPORT OF EXERCISE DEVICE

FIELD OF THE INVENTION

This invention relates generally to exercise equipment. More particularly, this invention relates to a system for centering and incrementally positioning a bench or other user support relative to a frame used to support weights used in exercise.

BACKGROUND AND SUMMARY OF THE INVENTION

Bench press stands typically have a frame for supporting a barbell or other weight system and a bench or user support. The present invention provides an improvement in the construction of bench press and similar type stands.

With regard to the foregoing, the present invention is directed to a system for positioning a user support of an exercise device relative to a frame configured for supporting exercise weights. The system advantageously enables the user support to be centered relative to the frame (if such is desired) and to be incrementally or infinitesimally positioned along a dimension of the frame, such as the length dimension of the frame.

In a preferred embodiment, the system includes a user support having a user support surface. For example, the user support may preferably be a bench for performing bench press type exercises. A pair of positioning members are connected to the user support, with each positioning member extending outwardly from opposite sides of the user support and being substantially aligned along a common axis. For example, in a preferred embodiment, the positioning members may be rods that connect, preferably by a quick-release mechanism, to a base or support leg of the user support.

The system also includes a frame configured for supporting exercise weights. For example, the frame may be configured for supporting a barbell or the like for use with the bench to enable the user to perform bench press type exercises. The frame includes a pair of spaced apart portions, the spacing between the spaced apart portions of the frame defining a space configured for receiving the user support. In a preferred embodiment, the spaced apart portions are rails that extend parallel to one another adjacent the ground from opposite sides of the frame.

A guide is located on each of the spaced apart portions of the frame. Each guide defines a plurality of receivers each of which is configured for receiving a portion of one of the positioning members. The guides are each located such that the receivers of each guide are in substantial registry with one another. In a preferred embodiment, the guides are elongate metal strips having U-shaped notches uniformly defined along the length thereof. The user support is adjustably and incrementally positionable relative to the frame by selectively positioning the positioning members so that they are received by the receivers to effect selective positioning of the user support relative to the frame.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
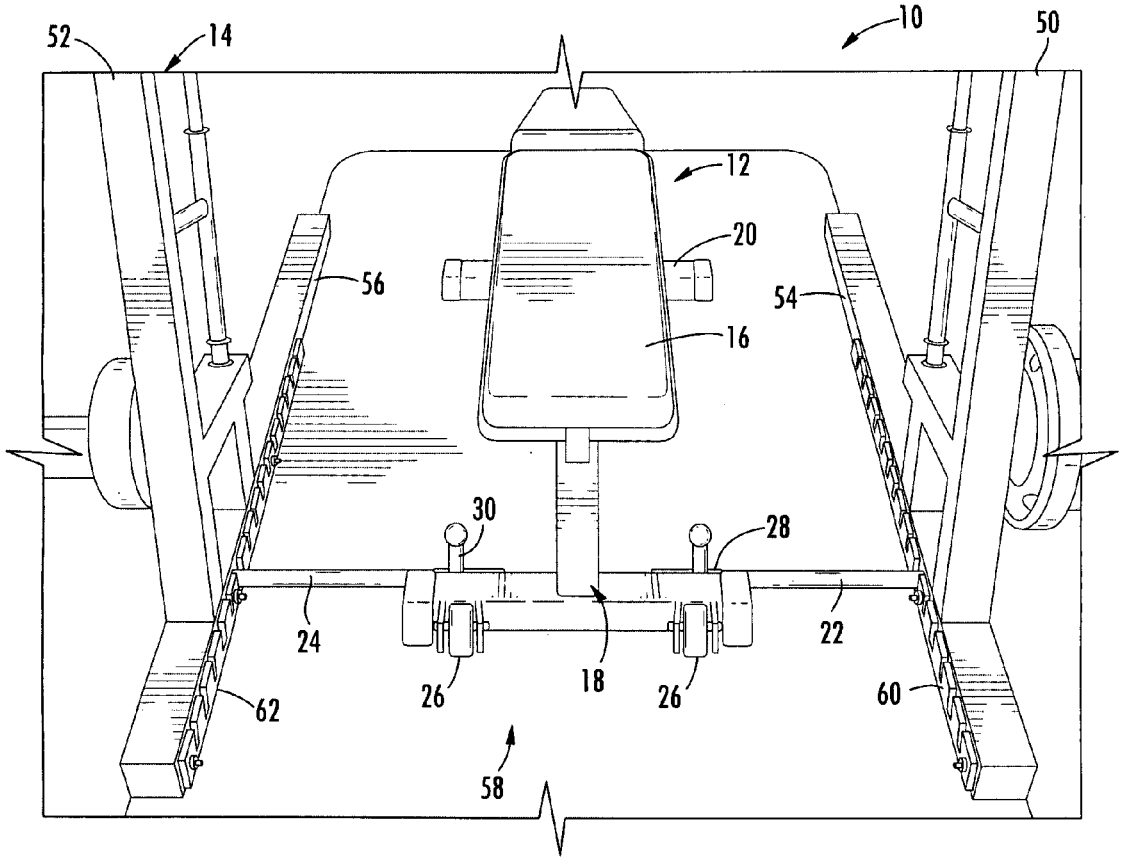
FIG. 1 is a rear perspective view of a positioning system in accordance with a preferred embodiment of the invention.
Figure 2:
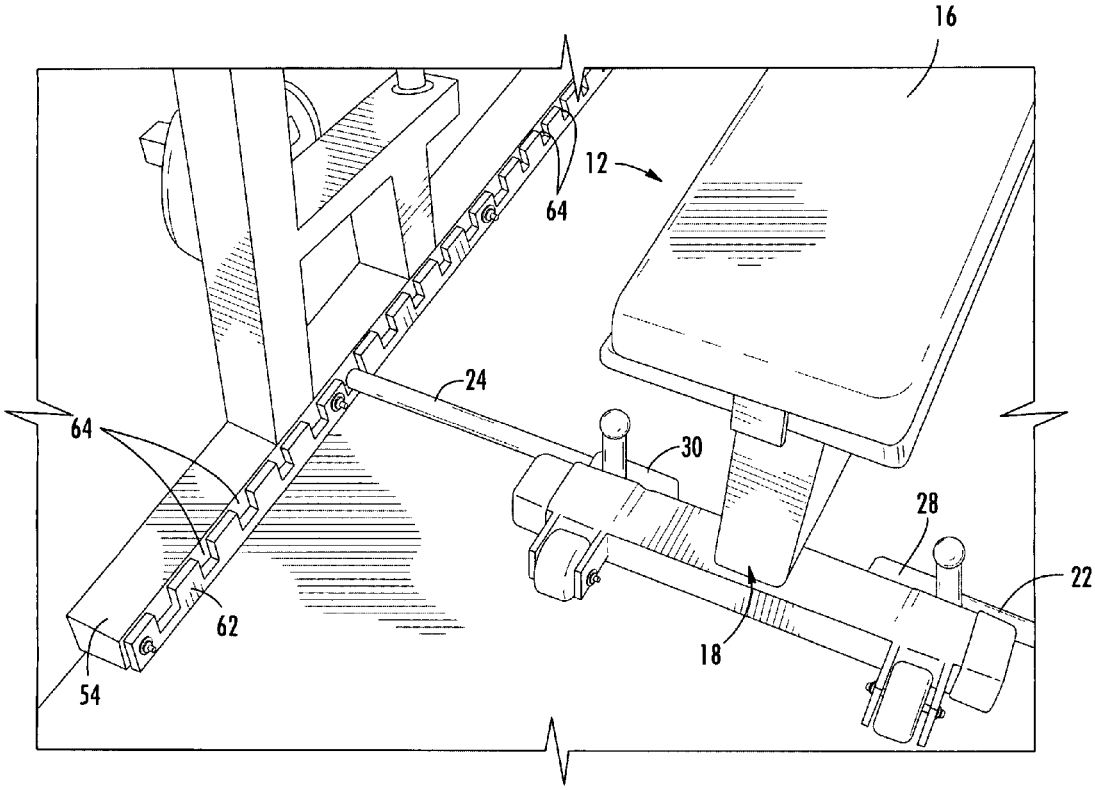
FIG. 2 is a close-up view of a portion of the system of FIG. 1.
Figure 3:
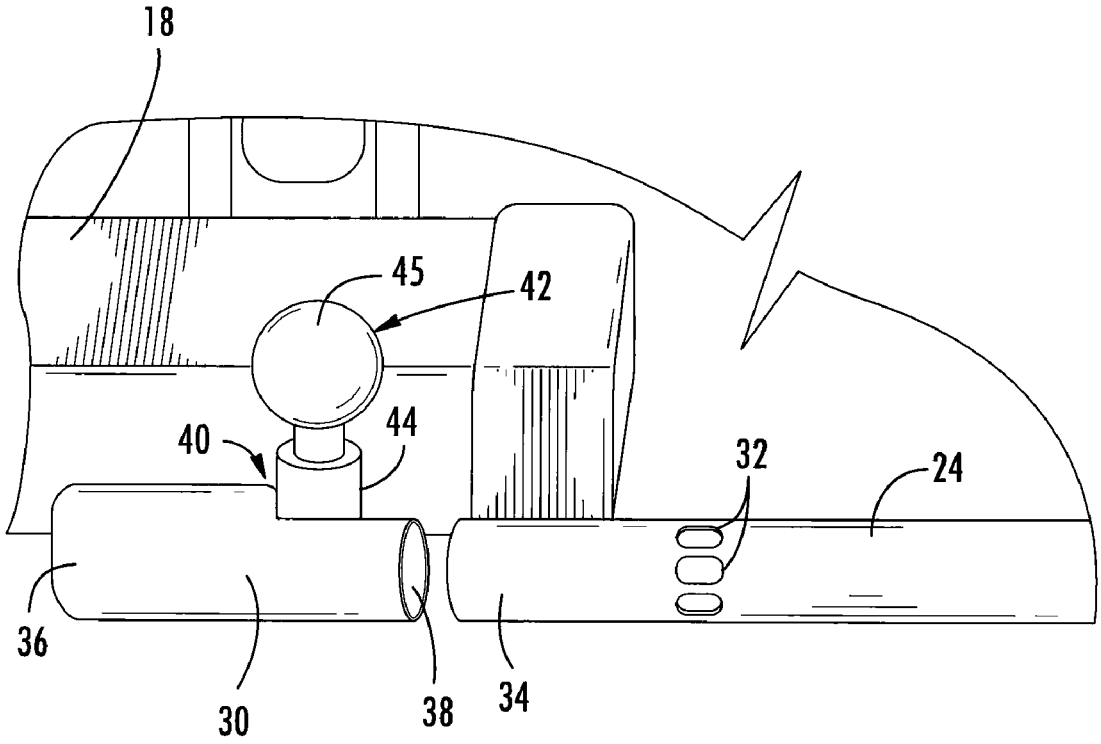
FIG. 3 is a detailed exploded view showing connection for removably connecting a positioning member of the system of FIG. 1 to a user support of the system of FIG. 1.

With reference to FIGS. 1–3, the invention relates to a system 10 for positioning a user support 12 of an exercise device relative to a frame 14 configured for supporting exercise weights. The system 10 advantageously enables the user support 12 to be centered relative to the frame 14 and to be incrementally positioned along a dimension of the frame 14, such as the length dimension of the frame.

The user support 12 is preferably configured as a bench and includes a user support surface 16 supported above the ground as by a pair of legs 18 and 20, one located at each end of the support 12. A pair of positioning members 22 and 24 are connected to the user support 12. Wheels 26 are preferably located at an end of the user support 12 to facilitate moving of the user support 12.

Each positioning member 22 and 24 extends outwardly from opposite sides of the user support 12 and are aligned along a common axis. The positioning members 22 and 24 are preferably removably connectable to the user support 12 as by attachment members 28 and 30 located on opposite sides of the leg 18. The positioning members 22 and 24 span between the user support 12 and the frame 14 as shown and are each preferably equal lengths of steel rod having a plurality of apertures 32 defined adjacent one end 34 thereof (FIG. 3). However, if it is desired to position the user support 12 off-center relative to the frame, the positioning members may be of unequal length, but with a combined length sufficient to reach across the span.

The attachment members 28 and 30 are each preferably provided as by a cylindrical section of steel pipe having a diameter sized to receive the end 34 of the positioning members. The attachment members 28 and 30 each preferably define a closed end 36 and an opposite open 38 for receiving the end 34. A lock 40 is provided as by a spring-loaded pin 42 housed within a lock cylinder 44 and communicating through a sidewall of the attachment members. As will be appreciated, a distal end of the pin 42 may be passed through one of the apertures 32 of the positioning member to lock the positioning member within the attachment member, with a spring urging the pin 42 to remain in the locked position. A knob 45 attached to the pin 42 limits the travel of the pin 42 and may be grasped by a user to pull the pin 42 out to release the positioning member.

The frame 14 is configured for supporting exercise weights and may be of a variety of configurations to support weights, such as a bench press or dumbells or the like. In this regard, the frame 14 is shown having a pair of vertical members 50 and 52 made of square steel tubing and which may be bench press type weight support posts or other otherwise configured for supporting weights, such as described in application Ser. No. 11/018,120, titled WEIGHT LIFTING MACHINE, filed concurrently herewith, and incorporated herein by reference.

The frame 14 also includes a pair of spaced apart portions 54 and 56 which preferably are made of square steel tubing and substantially parallel to one another and substantially normal to the vertical members 50 and 52. The spacing between the spaced apart portions 54 and 56 of the frame defines a space 58 configured for receiving the user support 12. Guides 60 and 62 are located on the spaced apart portions 54 and 56 of the frame 14. The guides 60 and 62 cooperate with the positioning members 22 and 24 to enable desired positioning of the user support 12 so as to retain it in a desired lateral position, such as centered, while enabling longitudinal adjustment of the user support along the space 58.

Each guide 60 and 62 defines a plurality of receivers 64, each of which is configured for receiving a portion of one of the positioning members 22 and 24. In this regard, it will be understood that the guides 60 and 62 are located such that the receivers 64 of each guide 60 and 62 are in substantial registry with one another. The guides 60 and 62 are preferably provided by elongate metal strips of a plate material and the receivers 64 are preferably provided by U-shaped notches uniformly defined, as by cutting, along the length of the guides 60 and 62. The guides 60 and 62 are preferably secured to the spaced apart portions 54 and 56 as by bolts or other fasteners.

Figure 4:
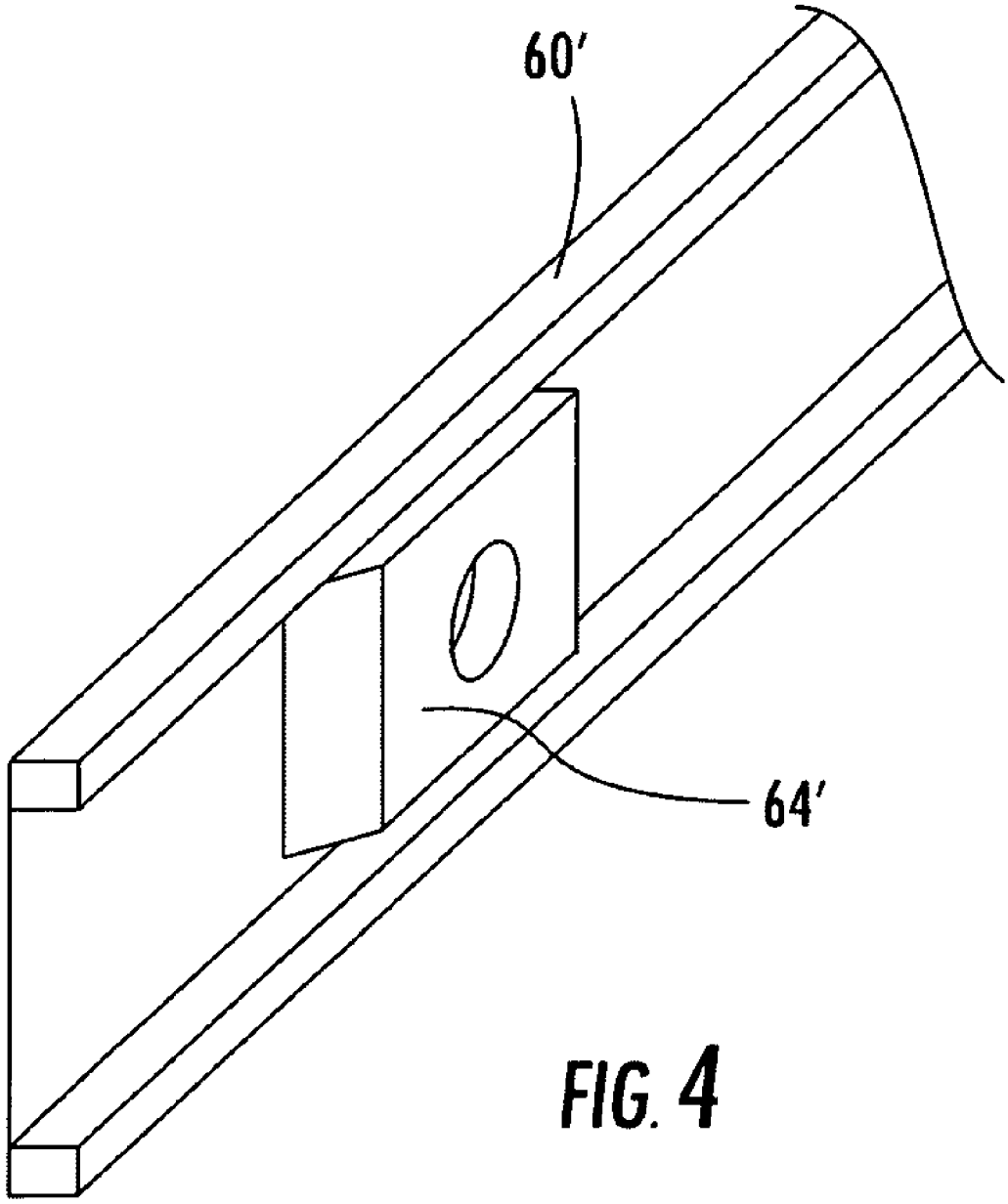
FIG. 4 shows an alternate embodiment of a guide and receiver component suitable for use with the system of FIG. 1.

As will be appreciated, the user support 12 may be adjustably and incrementally positionable relative to the frame 14 by selectively positioning the positioning members 22 and 24 so that they are received by the receivers 64 to effect selective positioning of the user support relative to the frame. The system 10 thus enables the position of the user support 12 to be fixed relative to the frame, but allowing the position to be adjusted if desired. However, it will be understood that other incremental receiver structures may be utilized, such as apertures defined in the spaced apart portions 54 and 56, and the like. Also, the guide/receiver structure may be configured to enable infinitesimal adjustment. For example, as seen in FIG. 4, a guide 60' in the form of a track having a receiver 64' slidably received in the guide 60' may be utilized. The receiver 64' is preferably slidably mounted within the track 60' as by a spring-loaded fitting such that when the spring force is released the receiver 64' may freely slide along the track, and the receiver 64' is otherwise urged by the spring against the track 60' so as to remain stationary.

One advantage of the system 10 is that the user support 12 will remain centered (or at another desired lateral orientation) relative to the frame 14, plus the longitudinal position of the user support 12 relative to the frame 14 may be incrementally adjusted by selectively positioning the positioning members 22, 24 within the receivers 64. This may be accomplished as by lifting the user support 12 slightly and dropping the members 22, 24 within the desired receivers 64.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A system for positioning a user support of an exercise device, comprising:

a user support having a user support surface;

a pair of positioning members connected to the user support, each positioning member extending outwardly from opposite sides of the user support and being substantially aligned along a common axis;

a frame configured for supporting exercise weights and including a pair of spaced apart portions, the spacing between the spaced apart portions of the frame defining a space configured for receiving the user support; and a guide located on each of the spaced apart portions of the frame, each guide defining a plurality of receivers each of which is configured for receiving a portion of one of the positioning members, with the guides each located such that the receivers of each guide are in substantial registry with one another, wherein the user support is adjustably and incrementally positionable relative to the frame by selectively positioning the positioning members so that they are received by the receivers to effect selective positioning of the user support relative to the frame.

2. The system of claim 1, wherein the user support comprises a bench.

3. The system of claim 1, wherein the spaced apart portions comprise tubing members located substantially parallel to one another.

4. The system of claim 1, wherein the positioning members are of substantially identical dimensions.

5. The system of claim 1, wherein the positioning members are releasably connected to the user support.

6. The system of claim 1, wherein the positioning members comprise rods and the user support further includes a pair of attachment members for receiving the positioning members.

7. The system of claim 1, wherein the spaced apart portions extend parallel to and facing one another and positioned adjacent opposite sides of the user support.

8. The system of claim 1, wherein the guides are elongate metal strips and the receivers are U-shaped notches uniformly defined along the length of the guides.

9. The system of claim 1, wherein the guides enable incremental adjustment of the position of the user support.

10. The system of claim 1, wherein the guides enable infinitesimal adjustment of the position of the user support.

* * * * *